US007896579B2

(12) United States Patent
Craig

(10) Patent No.: US 7,896,579 B2
(45) Date of Patent: Mar. 1, 2011

(54) END COUPLING FOR A ROCK BOLT

(75) Inventor: Peter Harold Craig, Cooyal (AU)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 0 days.

(21) Appl. No.: 12/203,365

(22) Filed: Sep. 3, 2008

(65) Prior Publication Data

US 2009/0074517 A1 Mar. 19, 2009

(30) Foreign Application Priority Data

Sep. 4, 2007 (AU) ..... 2007904781

(51) Int. Cl.
*E21D 21/00* (2006.01)

(52) U.S. Cl. ..... 405/259.1; 411/5; 405/288; 405/302.1

(58) Field of Classification Search ..... 405/259.1, 405/288, 302.1; 411/5, 8, 14, 427
See application file for complete search history.

(56) References Cited

U.S. PATENT DOCUMENTS 4,295,761 A * 10/1981 Hansen ..... 405/259.1
4,303,354 A * 12/1981 McDowell, Jr. ..... 405/302.1
4,349,299 A * 9/1982 Eny ..... 405/259.6
4,427,326 A * 1/1984 Hobson et al. ..... 411/5
4,502,825 A * 3/1985 Yamada ..... 411/5
4,618,291 A * 10/1986 Wright ..... 411/427
4,957,401 A * 9/1990 Hatter ..... 411/5
5,791,823 A * 8/1998 Blakley et al. ..... 405/259.1
5,865,581 A * 2/1999 Sadri et al. ..... 411/5
6,994,496 B2 * 2/2006 Mills ..... 405/288
7,001,109 B2 * 2/2006 Mongrain ..... 405/259.1

* cited by examiner

*Primary Examiner*—Frederick L Lagman
(74) *Attorney, Agent, or Firm*—The Webb Law Firm

(57) ABSTRACT

An end coupling 1, 19 for a shaft 2 of a rock bolt 50 comprises a body 6 having a lead portion 8 with a leading end 9, and a tail portion 10 with a trailing end 11. The tail portion 10 is arranged to be connected to a drive to impart rotation to the coupling about its axis. The body 6 defines a passage 7 extending between the leading and trailing ends and a first portion 12 of the passage 7 extends from the leading end 9 and has a first diameter. A second portion 15 of the passage 7 is disposed adjacent the first portion 12 and has a second diameter that is larger than said first diameter. A first thread 14 extends along at least part of the first portion 12 of the passage 7 and is arranged to engage an external thread 4 on the rock bolt shaft 2. A rock bolt assembly incorporating the end coupling 1, 19 is also disclosed.

15 Claims, 5 Drawing Sheets

END COUPLING FOR A ROCK BOLT

TECHNICAL FIELD

The present invention relates generally to threaded end couplings and more specifically, but not exclusively, to end couplings for rock bolts and rock bolt assemblies incorporating such end couplings.

BACKGROUND OF THE INVENTION

Roof and wall support is vital in mining and tunnelling operations. Mine and tunnel walls and roofs consist of rock strata, which must be reinforced to prevent the possibility of collapse. Rock bolts are widely used for consolidating the rock strata.

In conventional strata support systems, a bore is drilled into the rock by a drill rod, which is then removed and a rock bolt is then installed in the drilled hole and secured in place typically using a resin or cement based grout. The rock bolt is tensioned which allows consolidation of the strata by placing that strata in compression. The rock bolt is typically formed from a steel rod.

To allow the rock bolt to be tensioned, the end of the bolt may be anchored mechanically to the rock formation by engagement of an expansion assembly on the end of bolt with the rock formation. Alternatively, the bolt may be adhesively bonded to the rock formation with a resin bonding material inserted into the bore hole. Alternatively, a combination of mechanical anchoring and resin bonding can be employed by using both an expansion assembly and resin bonding material.

In some environments it is preferable that there is no tail protruding from the rock face. This is problematic as it makes it difficult to rotate the installed bolt to effect adequate mixing of the resin or grout and to subsequently tension the bolt once the resin/grout has set.

SUMMARY OF THE INVENTION

According to a first aspect, there is provided an end coupling for a shaft having an end portion incorporating an external thread, the coupling having an axis and comprising a body having a lead portion incorporating a leading end, and a tail portion incorporating a trailing end, the tail portion being arranged to be connected to a drive to impart rotation to the coupling about the axis, wherein the body defines a passage extending along the axis between said leading and trailing ends, a first portion of the passage extending from the leading end and having a first diameter, and a second portion of the passage disposed adjacent the first portion and having a second diameter that is larger than said first diameter, and a first thread extending along at least part of the first portion of the passage and being arranged to threadingly engage the external thread on the shaft.

Accordingly, an end coupling according to the above form is arranged to receive the end portion of shaft within the coupling passage. With this arrangement the shaft may be threadingly engaged with the lead portion of the coupling whilst the tail portion of the coupling, on which a drive may be mounted to rotate the shaft, may extend beyond the end of the shaft. In this way the tail portion may be more accessible, particularly in situations where the end of shaft is recessed in a bore such as may occur in some rock bolting applications.

In one form, the lead portion has a low profile thereby allowing it to locate in a bore containing the shaft without requiring any, or only minimal, enlarging of the bore. In rock bolting applications, there is typically an annular space of approximately 3-8 mm thickness between the bore wall and a rock bolt shaft to allow adequate passage of grout/resin. Accordingly if the lead portion is sufficiently slim, the coupling can locate in the bore without requiring enlargement of the whole utilising this gap. In a particular form, the lead portion has a generally cylindrical outer surface having a maximum radial displacement from the axis which is not more than 30% greater than the nominal radius of the shaft.

To allow the end coupling to impart rotation to the shaft, it is necessary that there is some mechanism for torque to be transferred between the end coupling and the shaft.

In one form, this torque transfer is provided by incorporation of a polymeric plug in the passage in spaced relation from said leading end. In use, when the shaft is received in the coupling and in threaded engagement with the first thread, the coupling is wound in a first direction onto the shaft until end of the shaft engages with the plug. When so engaged, the coupling is able to impart torque up to a threshold level under rotation of the coupling in this first direction as the plug acts as a stop and prevents any further relative rotation between coupling and shaft. However, at torque levels above the threshold, the plug is caused to fail by disengaging from the coupling body, thereby allowing the coupling to move axially along the shaft under continued rotation in the first direction. In one form, the plug is injected moulded into the passage. In one form the plug is in intimate contact with the first thread to allow for the plug to have sufficient break out strength. In one form the torque threshold at which the plug will fail is in the range of 40-160 N.m.

In another form the torque transfer is provided by a stop element disposed on the end portion of the shaft, the stop element being enlarged as compared to the rock bolt shaft. When the shaft is received in the passage, the stop is arranged to engage with the internal abutment surface in the end coupling.

In one form the end coupling further comprises an abutment arrangement disposed on the exterior of said tail portion and forming an external abutment surface that faces said leading end. In one form the abutment arrangement is integrally formed with said coupling body. In one form the abutment arrangement is in the form of a flat washer. In another form the abutment arrangement is in the form of a dome washer.

In one form a second thread extends along at least a part of the second portion of the passage and is arranged to threadedly engage a threaded shaft received in the passage from the trailing end of said coupling.

In a further aspect, there is provided a rock bolt assembly having a rock bolt including a shaft, and an end coupling in accordance with any form described above where an end of the shaft is receivable within the passage of the coupling.

DETAILED DESCRIPTION OF A PREFERRED EMBODIMENT

Figure 1:
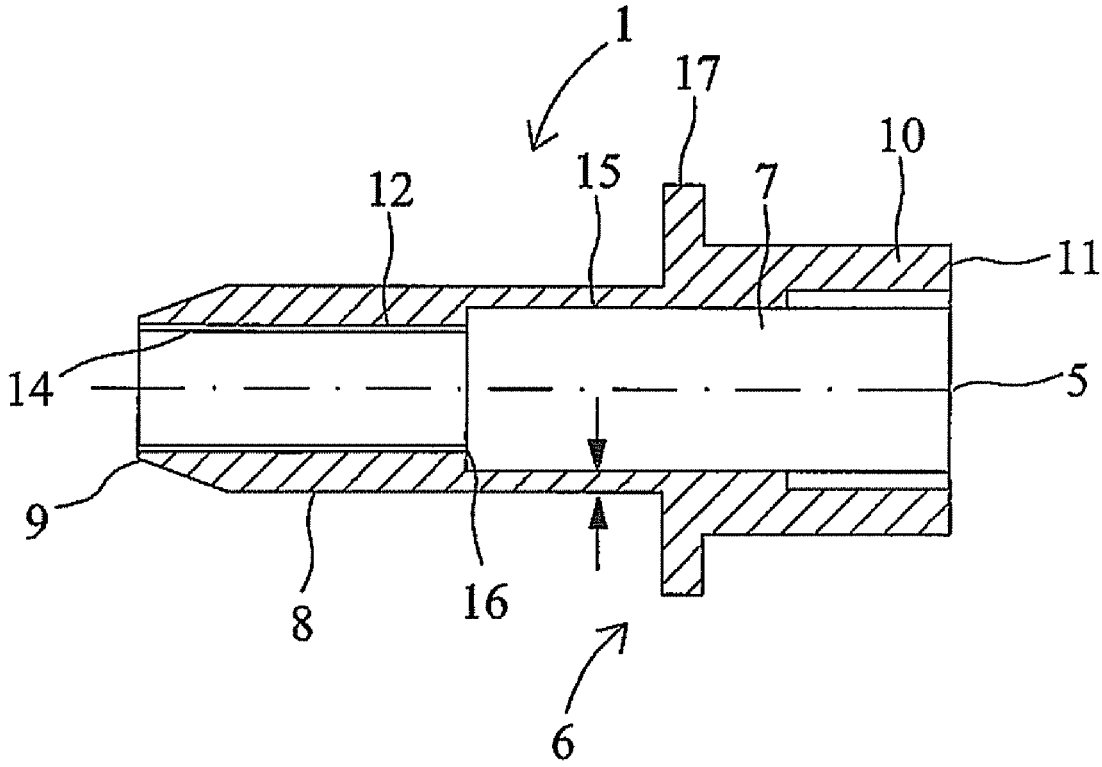
FIG. 1 is a cross-sectional view of one embodiment of an end coupling.
Figure 2:
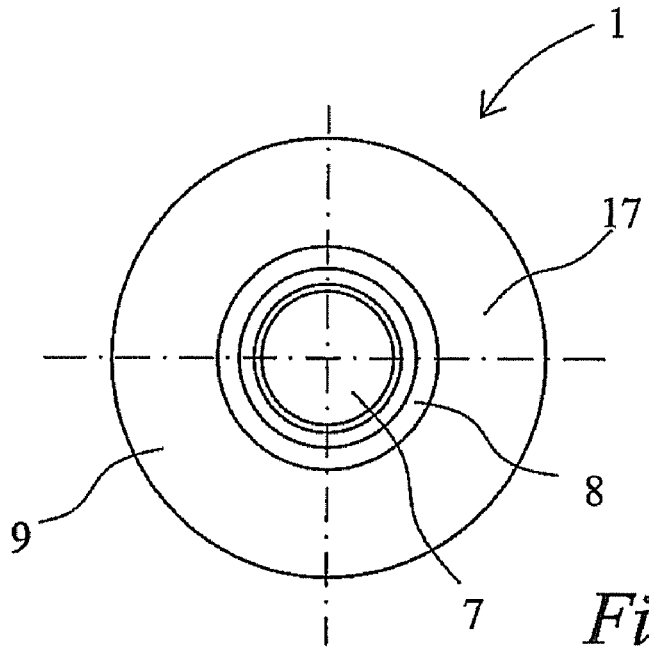
FIG. 2 is a leading end view of the end coupling of FIG. 1.
Figure 3:
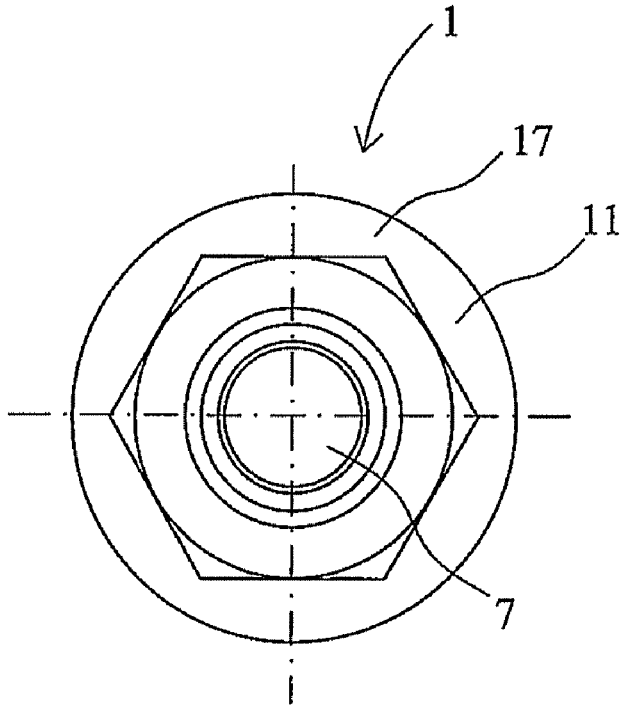
FIG. 3 is a trailing end view of the end coupling of FIG. 1.

Referring to the FIGS. 1 to 6, disclosed is an end coupling 1 for a shaft 2 of a rock bolt. The shaft 2 has an end portion 3 which has an external thread 4. The coupling 1 is arranged to be coupled to the external thread 4 and is adapted to allow rotation to be imparted to the shaft 2 when it is located in a bore 10 formed in rock 100 with little or no shaft tail protruding from the rock face 102.

The end coupling 1 has an axis 5 extending longitudinally along the end coupling 1. The end coupling 1 is adapted to be rotated about the axis 5.

The end coupling 1 comprises a body 6 having a lead portion 8 with a leading end 9. The body 6 further comprises a tail portion 10 which includes a trailing end 11. The tail portion 10 is arranged to be engaged with a drive to impart rotation to the coupling 1 about the axis 5. In this respect, in the illustrated form, the tail portion 10 has a non-circular outer surface (which in the form shown is hexagonal—see FIG. 3).

The body 6 defines a passage 7 extending along the axis 5 between the leading end 9 and the trailing end 11. The passage 7 has a first portion 12 extending from and positioned proximal to the leading end 9. The first portion 12 of the passage 7 has an internal diameter and at least a portion of the first portion 12 of the passage 7 is internally threaded with first thread 14. This first thread 14 allows the first portion 12 of the passage 7 to threadedly engage the external thread 4 on the end portion 3 of the shaft 2. Hence, this allows the shaft 2 to be threadedly engaged with the end coupling 1.

The body 6 further includes a second portion 15 of the passage 7 which has an internal diameter greater than the internal diameter of the first portion 12.

The difference in diameter between the first portion 12 and the second portion 15 of the passage 7 results in an abutment shoulder 16 positioned between the first portion 12 and a second portion 15 and facing the trailing end 11.

The end coupling 1 further includes an external abutment shoulder 17 disposed on the exterior of the tail portion 10. This external abutment 17 is typically in the form of a flat washer or a domed washer.

The arrangement of the end coupling 1 allows end portion 3 of the shaft 2 to be threadingly engaged with the lead portion 9 of the end coupling 1 while the tail portion 10 of the coupling 1 extends beyond the end of the shaft 2. Hence, the tail portion 10 is accessible for engagement with a drive which may be mounted on the tail portion 10 to rotate the shaft 2. This allows for the shaft 2 to be positioned within a bore having little to no tail protruding from the rock face but still allows the coupling to input torque to the shaft 2 and tensioning of the rock bolt as will be described in more detail below.

Figure 4:
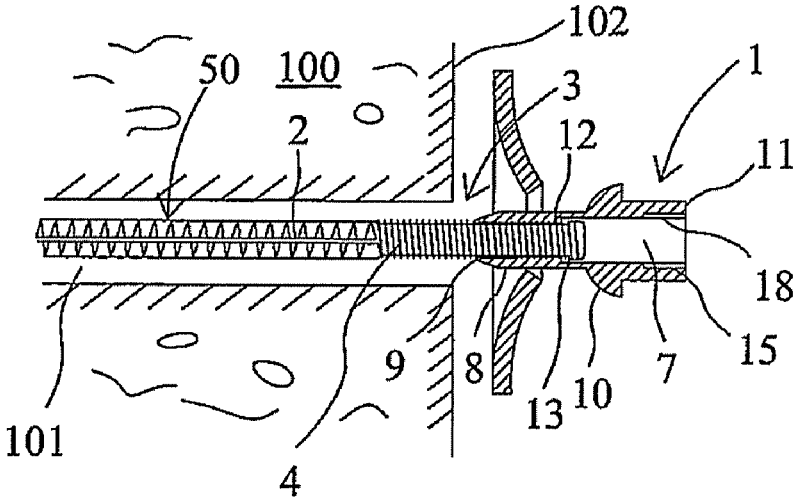
FIG. 4 is a cross-sectional view of the end coupling of FIG. 1 in use.
Figure 5:
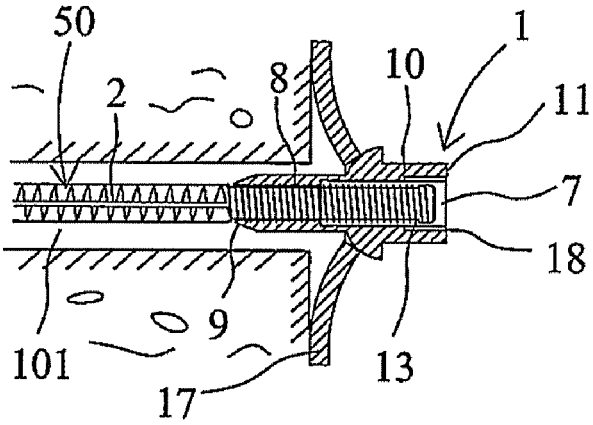
FIG. 5 is a cross-sectional view of the end coupling of FIG. 1 in use.
Figure 6:
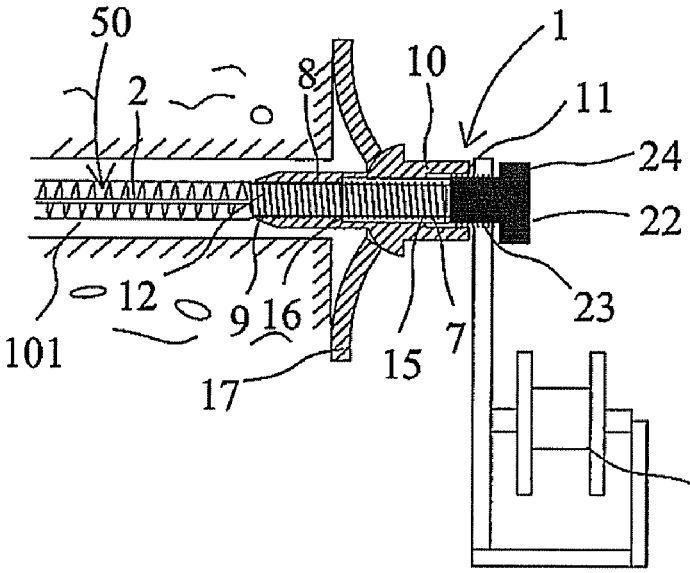
FIG. 6 is a cross-sectional view of the end coupling of FIG. 1 in use.
Figure 7:
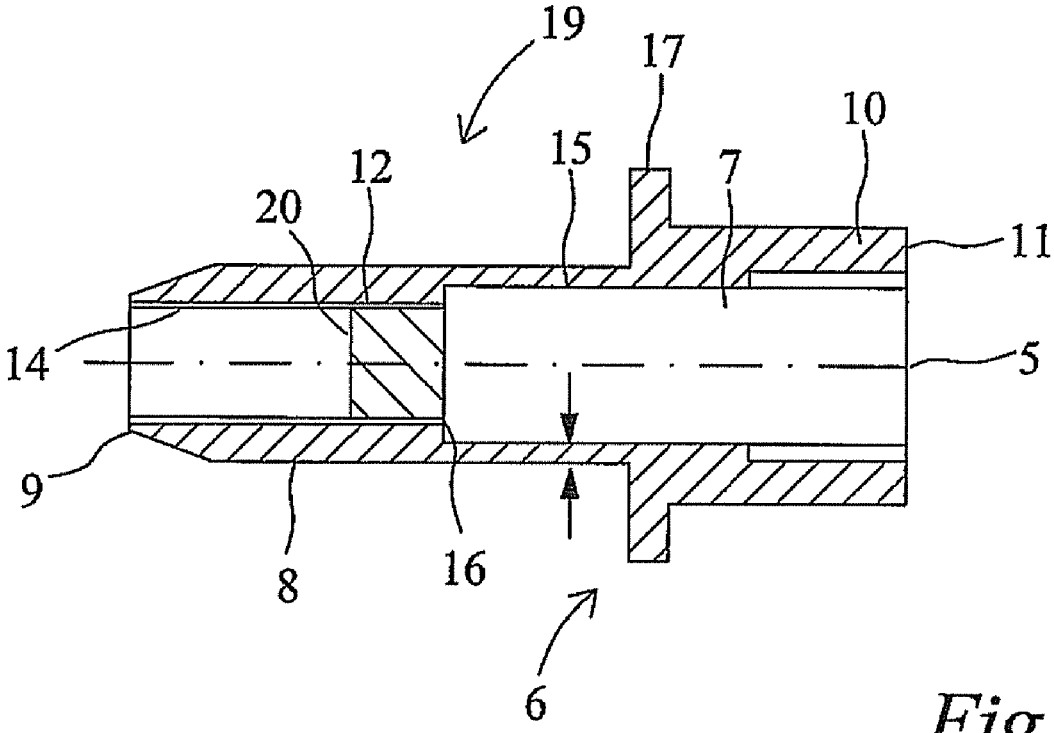
FIG. 7 is a cross-sectional view of a second embodiment of an end coupling.

Turning to FIGS. 4 to 6, a rock bolt assembly is shown comprising the coupling 1 assembled on the shaft 2. In this embodiment, the shaft 2 includes a stop 13 at its distal end which is arranged to locate in the second portion 15 of the passage 7. The stop 13 prevents the end coupling from winding off the shaft end as it is arranged to engage with the internal abutment 16. To locate the stop 13 in this position, the coupling 1 is mounted to the shaft 2 prior to installation in the bore 101. The shaft is fed into the coupling 1 from the trailing end 11 until the thread 4 on the end portion 3 moves into engagement with the first thread 14 formed on the coupling. The coupling is then wound in a first direction up the shaft by engagement of the threads 4 and 14 until the stop 13 moves into engagement with the abutment 16. The assembly is now in its installation position (as shown in FIG. 4) where any further rotation of the coupling 1 in the first direction imparts a corresponding rotation to the shaft 2 by virtue of the engagement of the stop 13 with the abutment 16.

When in its installation position the coupling 1 and shaft 2 are ready to be installed in the bore 101 as shown in FIG. 4. The coupling 1 is able to be rotated in the first direction (typically by engaging the tail portion 10) which imparts a corresponding rotation to the shaft which can be used to activate a point anchor of the rock bolt (not shown) which may be either a mechanical anchor and/or a resin cartridge. After activation of the point anchor the rock bolt 50 is ready to be tensioned. This is achieved by rotating the coupling 1 in an opposite second direction which causes the coupling to wind down the end portion of the shaft as a result of engagement between the thread 4 on the shaft and the internal first thread 14 in the coupling. As shown in FIG. 5, this causes the stop 13 to move out of engagement with the abutment surface and causes the external abutment 17 to move into engagement with the rock face 102 thereby placing the shaft 2 in tension. Rock support is therefore achieved.

In addition to supporting the rock strata, the coupling can be used to locate attachments 21 as shown in FIG. 6. In particular the tail portion 10 of the coupling 1 includes an internal thread 18 which extends to the trailing end 11. A corresponding nut 22 having an external thread 23 may be secured to the tail end 11 of the coupling 1 by engagement of the threads 18 and 23. By locating the attachment 21 between a head 24 of the nut 22 and the end 11 of the coupling 1 a simple means of securing the attachment 21 to the rock bolt assembly is achieved. Typically the attachment 21 is in the form of hanging brackets or the like which are often required in mining applications to support mine services.

FIGS. 7 to 10 illustrate coupling 19 according to a second embodiment. As the coupling 19 includes many of the features of the earlier embodiment like features have been given like reference numerals.

Figure 8:
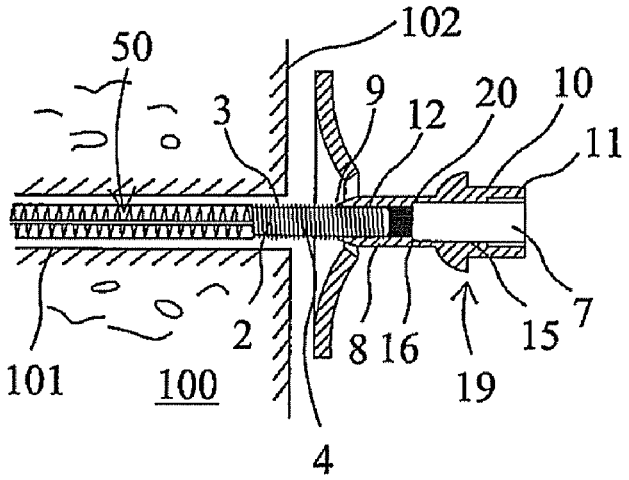
FIG. 8 is a cross-sectional view of the end coupling of FIG. 5 in use.

The primary distinction between the coupling 19 and the coupling 1 of the earlier embodiment is that a polymeric plug is positioned within the passage, specifically within the first portion 12. This polymeric plug is injection moulded into the passage 7 in intimate contact with the first thread 14 of the first portion 12. The coupling 19 is arranged to be used with a rock bolt 50 having an end portion 3 incorporating an external thread which extends to the distal end of the shaft 2. As such, the shaft 2 does not include the stop 13 as in the earlier embodiment. With this arrangement, the coupling 19 is arranged to be screwed on to the end portion 3 of the shaft until the end of the shaft is in abutment with the plug 20. This arrangement is shown in FIG. 8. When so arranged, the coupling 19 is able to impart torque to the shaft 2 when the shaft is rotated in the second direction (i.e. in a direction which causes the coupling to wind down the shaft end). This torque is able to be imparted by virtue of the engagement of the end of the shaft 2 with the polymeric plug 20.

Figure 9:
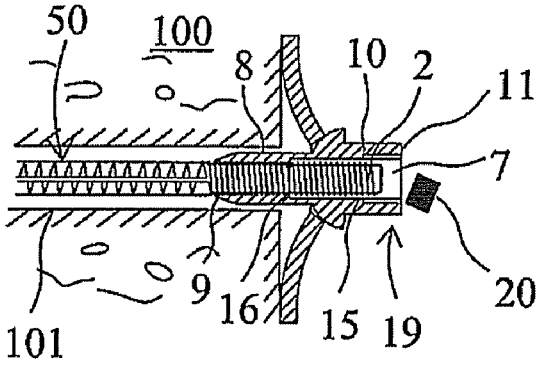
FIG. 9 is a cross-sectional view of the end coupling of FIG. 5 in use.
Figure 10:
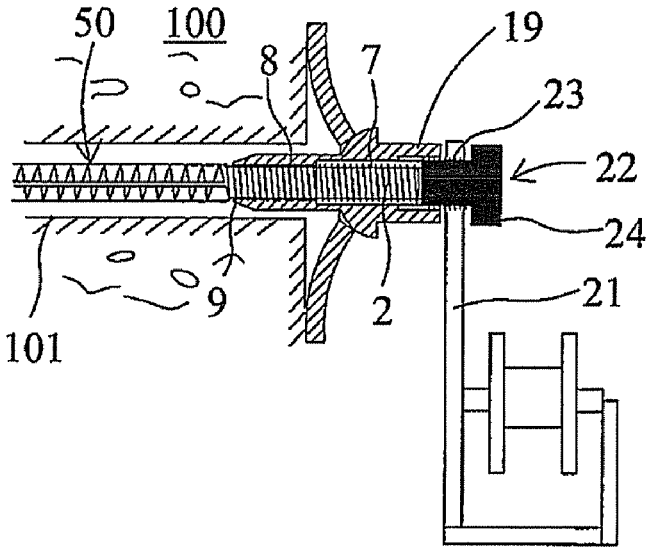
FIG. 10 is a cross-sectional view of the end coupling of FIG. 5 in use.

When a threshold level of torque is placed on the end coupling 19 the polymeric plug 20 is arranged to disengage from the first thread 14. At this point the polymeric plug 20 is expelled from the first portion of the passage through the tailing end 11. typically the torque threshold at which the plug will fail is in the range of 40-160 N.m. Thereafter the coupling 19 is able to wind down the shaft end so as to cause tensioning of the shaft 2 by moving the external abutment surface 17 into engagement with the rock face 102 as shown in FIG. 9.

Again, in a similar arrangement to the earlier embodiment, attachments 21 are able to be secured to the end of the coupling by virtue of the internal thread 18 formed within the tail portion 10 of the coupling 19.

Accordingly, an end coupling and rock bolt assembly is provided which allows for both the transfer of torque and tensioning of rock bolts for use in mining and similar applications. Furthermore, in at least one form, the coupling is multifunctional and also provides an arrangement to allow easier fitting of related attachments for use in such operations.

It is to be understood that a reference herein to a prior art document does not constitute an admission that the document forms part of the common general knowledge in the art in Australia or in any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An end coupling for a shaft having an external thread, the coupling having an axis and comprising a body having a lead portion incorporating a leading end, and a tail portion incorporating a trailing end, the tail portion being arranged to be connected to a drive to impart rotation to the coupling about the axis, wherein the body defines a passage extending along the axis between said leading and trailing ends, a first portion of the passage extending from the leading end and having a first diameter, and a second portion of the passage disposed adjacent the first portion and having a second diameter that is larger than said first diameter, and a first thread extending along at least part of the first portion of the passage and being arranged to threadingly engage the external thread on the shaft, and a polymeric plug disposed in the passage in spaced relation from said leading end and arranged to allow torque up to a threshold level to be applied to the shaft through the coupling.

2. An end coupling according to claim 1, wherein the plug is disposed in the first portion of said passage.

3. An end coupling according to claim 2, wherein said plug is engaged with said first thread.

4. An end coupling according to claim 1, wherein the threshold level is in the range of 40-160 N.m.

5. An end coupling according to claim 1, further comprising an abutment arrangement disposed on an exterior of said tail portion and forming an external abutment surface that faces said leading end, wherein the abutment arrangement is integrally formed with said coupling body.

6. An end coupling according to claim 1, further comprising an abutment arrangement disposed on an exterior of said tail portion and forming an external abutment surface that faces said leading end, wherein said abutment arrangement is in the form of a flat washer.

7. An end coupling according to claim 1, further comprising an abutment arrangement disposed on an exterior of said tail portion and forming an external abutment surface that faces said leading end wherein said abutment arrangement is in the form of a dome washer.

8. An end coupling according to claim 1, wherein said passage extends to said trailing end.

9. An end coupling for a shaft having an external thread, the coupling having an axis and comprising a body having a lead portion incorporating a leading end, and a tail portion incorporating a trailing end, the tail portion being arranged to be connected to a drive to impart rotation to the coupling about the axis, wherein the body defines a passage extending along the axis between said leading and trailing ends, a first portion of the passage extending from the leading end and having a first diameter, and a second portion of the passage disposed adjacent the first portion and having a second diameter that is larger than said first diameter, and a first thread extending along at least part of the first portion of the passage and being arranged to threadingly engage the external thread on the shaft, wherein said passage extends to said trailing end, and wherein a second thread extends along at least a part of the second portion of the passage and is arranged to threadingly engage a threaded shaft received in the passage from the trailing end of said coupling.

10. An end coupling according to claim 9, wherein the coupling body is formed from steel.

11. A rock bolt assembly comprising:

a rock bolt having a shaft extending between opposite first and second ends, a portion of the shaft adjacent said second end incorporating an external thread; and an end coupling having an axis and comprising a body having a lead portion incorporating a leading end, a tail portion incorporating a trailing end, and an abutment arrangement disposed on an exterior of said tail portion and forming an external abutment surface that faces said leading end, the tail portion being arranged to be connected to a drive to impart rotation to the coupling about the axis, wherein the body defines a passage extending along the axis between said leading and trailing ends, a first portion of the passage extending from the leading end and having a first diameter, and a second portion of the passage disposed adjacent the first portion and having a second diameter that is larger than said first diameter, and a first thread extending along at least part of the first portion of the passage and being arranged to threadingly engage the external thread on the shaft; and a polymeric plug disposed in the passage in spaced relation from said leading end and arranged to allow torque up to a threshold level to be applied to the shaft through the coupling, wherein the second end of the shaft is received in the passage of the end coupling with the external thread being co-operable with the first thread on the shaft and the tail portion of the coupling extending beyond the shaft second end.

12. A rock bolt assembly according to claim 11, wherein when the shaft is received within the passage, the second end of the shaft is engaged with the plug, and when so engaged, the coupling is able to impart torque up to the threshold level under rotation of the coupling in a first direction and is able to move axially along the shaft under continued rotation in the first direction under torque levels above the threshold level by disengagement of the plug from the coupling body.

13. A rock bolt assembly according to claim 11, wherein the lead portion has a generally cylindrical outer surface having a maximum radial displacement from the axis which is not more than 30% greater than the nominal radius of the shaft.

14. A rock bolt assembly according to claim 11, wherein said passage extends to said trailing end, and wherein a second thread extends along at least a part of the second portion of the passage and is arranged to threadingly engage a threaded shaft received in the passage from the trailing end of said coupling.

15. A rock bolt assembly comprising:

a rock bolt having a shaft extending between opposite first and second ends, a portion of the shaft adjacent said second end incorporating an external thread; and an end coupling having an axis and comprising a body having a lead portion incorporating a leading end, a tail portion incorporating a trailing end, the tail portion being arranged to be connected to a drive to impart rotation to the coupling about the axis, wherein the body defines a passage extending along the axis between said leading and trailing ends, a first portion of the passage extending from the leading end and having a first diameter, and a second portion of the passage disposed adjacent the first portion and having a second diameter that is larger than said first diameter, and a first thread extending along at least part of the first portion of the passage and being arranged to threadingly engage the external thread on the shaft, wherein the second end of the shaft is received in the passage of the end coupling with the external thread being co-operable with the first thread on the shaft and the tail portion of the coupling extending beyond the shaft second end, wherein an abutment shoulder is formed in the passage between said first and second portions, said internal abutment shoulder facing said trailing end, and wherein a stop element is disposed on the second end of the shaft, the stop element being enlarged as compared to the rock bolt shaft, and wherein when the shaft is received in the passage, the stop is located in the second portion of the shaft and is arranged to engage with the internal abutment surface, and when so engaged, the coupling is able to impart torque to the shaft under rotation of the coupling in a first opposite direction and is able to move axially along the shaft under rotation of the coupling in a second direction.

* * * * *